US006895098B2

(12) United States Patent
Allegro et al.

(10) Patent No.: US 6,895,098 B2
(45) Date of Patent: May 17, 2005

(54) METHOD FOR OPERATING A HEARING DEVICE, AND HEARING DEVICE

(75) Inventors: Sylvia Allegro, Oetwil am See (CH); Michael Büchler, Zürich (CH)

(73) Assignee: Phonak AG, Stafa (CH)

( * ) Notice: Subject to any disclaimer, the term of this patent is extended or adjusted under 35 U.S.C. 154(b) by 295 days.

(21) Appl. No.: 09/755,468

(22) Filed: Jan. 5, 2001

(65) Prior Publication Data

US 2002/0090098 A1 Jul. 11, 2002

(51) Int. Cl.[7] ..... H04R 25/00
(52) U.S. Cl. ..... 381/312; 381/318
(58) Field of Search ..... 381/92, 312, 313, 381/314, 317, 318, 71.1, 94.3

(56) References Cited

U.S. PATENT DOCUMENTS 6,009,396 A * 12/1999 Nagata ..... 381/92
6,157,727 A * 12/2000 Rueda ..... 381/312
6,240,192 B1 * 5/2001 Brennan et al. ..... 381/314
6,453,284 B1 * 9/2002 Paschall ..... 381/94.3
6,529,866 B1 * 3/2003 Cope et al. ..... 381/94.3

OTHER PUBLICATIONS

Fundamentals of Hearing, Chapter 15, "Auditory Perception and Sound Source Determination", pp. 213–237, William A. Yost, 1977 by Academic Press, Inc.
Human Psychophysics, Chapter 6, "Auditory Perception", pp. 193–236, William A. Yost and Stanley Sheft, 1993.
Auditory Scene Analysis, Chapter 1, "The Auditory Scene", pp.1–45, Albert S. Bregman, 1990.

* cited by examiner

*Primary Examiner*—Suhan Ni
(74) *Attorney, Agent, or Firm*—Pearne & Gordon LLP

(57) ABSTRACT

A method for operating a hearing device (1) including the extraction, during an extraction phase, of characteristic features from an acoustical signal captured by at least one microphone (2*a*, 2*b*), and the processing, during an identification phase and with the aid of Hidden Markov Models, of the characteristic features especially for the determination of a momentary acoustic scene or of sounds and/or for voice and word recognition. A hearing device is also specified.

33 Claims, 1 Drawing Sheet

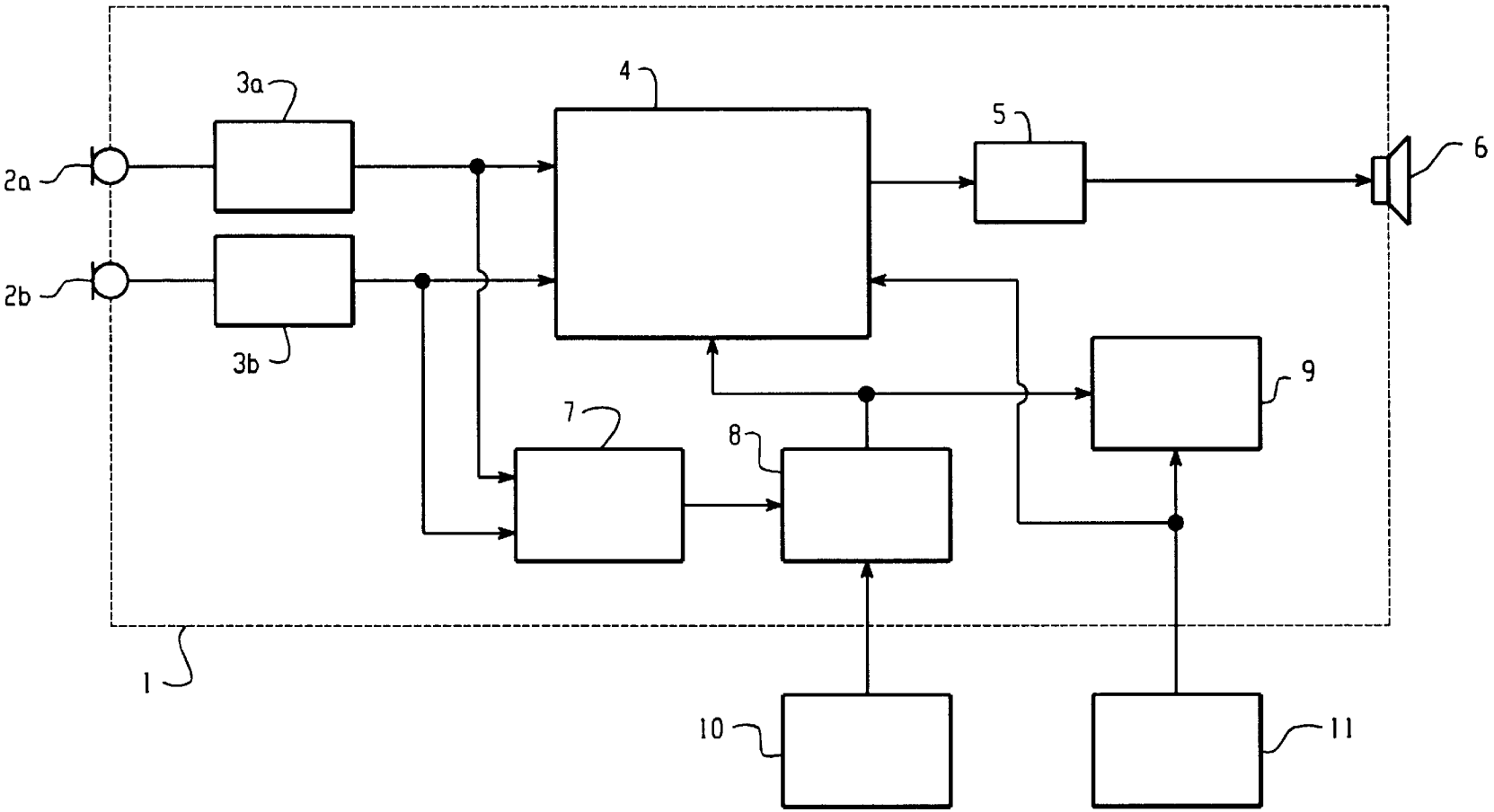
6
5
4
3a
3b
2a
2b
9
8
7
11
10
1

METHOD FOR OPERATING A HEARING DEVICE, AND HEARING DEVICE

This invention relates to a method for operating a hearing device, and to a hearing device.

BACKGROUND OF THE INVENTION

Modern-day hearing aids, when employing different audiophonic programs—typically two to a maximum of three such hearing programs—permit their adaptation to varying acoustic environments or scenes. The idea is to optimize the effectiveness of the hearing aid for its user in all situations.

The hearing program can be selected either via a remote control or by means of a selector switch on the hearing aid itself. For many users, however, having to switch program settings is a nuisance, or difficult, or even impossible. Nor is it always easy even for experienced wearers of hearing aids to determine at what point in time which program is most comfortable and offers optimal speech discrimination. An automatic recognition of the acoustic scene and corresponding automatic switching of the program setting in the hearing aid is therefore desirable.

There exist several different approaches to the automatic classification of acoustic surroundings. All of the methods concerned involve the extraction of different characteristics from the input signal which may be derived from one or several microphones in the hearing aid. Based on these characteristics, a pattern-recognition device employing a particular algorithm makes a determination as to the attribution of the analyzed signal to a specific acoustic environment. These various existing methods differ from one another both in terms of the characteristics on the basis of which they define the acoustic scene (signal analysis) and with regard to the pattern-recognition device which serves to classify these characteristics (signal identification).

For the extraction of characteristics in audio signals, J. M. Kates in his article titled "Classification of Background Noises for Hearing-Aid Applications" (1995, Journal of the Acoustical Society of America 97(1), pp 461–469), suggested an analysis of time-related sound-level fluctuations and of the sound spectrum. On its parts, the European patent EP-B1-0 732 036 proposed an analysis of the amplitude histogram for obtaining the same result. Finally, the extraction of characteristics has been investigated and implemented based on an analysis of different modulation frequencies. In this connection, reference is made to the two papers by Ostendorf et al titled "Empirical Classification of Different Acoustic Signals and of Speech by Means of a Modulation-Frequency Analysis" (1997, DAGA 97, pp 608–609), and "Classification of Acoustic Signals Based on the Analysis of Modulation Spectra for Application in Digital Hearing Aids" (1998, DAGA 98, pp 402–403). A similar approach is described in an article by Edwards et al titled "Signal-processing algorithms for a new software-based, digital hearing device" (1998, The Hearing Journal 51, pp 44–52). Other possible characteristics include the sound level itself or the zero-passage rate as described for instance in the article by H. L. Hirsch, titled "Statistical Signal Characterization" (Artech House 1992). It is evident that the characteristics used to date for the analysis of audio signals are strictly based on system-specific parameters.

One shortcoming of these earlier sound-classification methods, involving characteristics extraction and pattern recognition, lies in the fact that, although unambiguous and solid identification of speech signal is basically possible, a number of different acoustic situations cannot be satisfactorily classified, or not at all. While these earlier methods permit a distinction between pure speech signals and "non-speech" sounds, meaning all other acoustic surroundings, that is not enough for selecting an optimal hearing program for a momentary acoustic situation. It follows that the number of possible hearing programs is limited to those two automatically recognizable acoustic situations or the hearing-aid wearer himself has to recognize the acoustic situations that are not covered and manually select the appropriate hearing program.

It is fundamentally possible to use prior-art pattern identification methods for sound classification purposes. Particularly suitable pattern-recognition systems are the so-called distance classifiers, Bayes classifiers, fuzzy-logic systems and neural networks. Details of the first two of the methods mentioned are contained in the publication titled "Pattern Classification and Scene Analysis" by Richard O. Duda and Peter E. Hart (John Wiley & Sons, 1973). For information on neural networks, reference is made to the treatise by Christopher M. Bishop, titled "Neural Networks for Pattern Recognition" (1995, Oxford University Press). Reference is also made to the following publications: Ostendorf et al, "Classification of Acoustic Signals Based on the Analysis of Modulation Spectra for Application in Digital Hearing Aids" (Zeitschrift fur Audiologie (Journal of Audiology), pp 148–150); F. Feldbusch, "Sound Recognition Using Neural Networks" (1998, Journal of Audiology, pp 30–36); European patent application, publication number EP-A1-0 814 636; and U.S. Pat. No. 5,604,812. Yet all of the pattern-recognition methods mentioned are deficient in one respect in that they merely model static properties of the sound categories of interest.

SUMMARY OF THE INVENTION

It is therefore the objective of this invention to introduce first of all a method for operating a hearing aid which compared to prior-art methods is substantially more reliable and more precise.

Provided is a method for operating a hearing device with said method including the steps of:

- the extraction, during an extraction phase, of characteristic features from an acoustic signal captured by at least one microphone, and
- the processing, during an identification phase and with the aid of Hidden Markov Models, of said characteristic features especially for the determination of a transient acoustic scene or of sounds and/or for voice and word recognition.

Also provided is a method as described above, whereby, for the identification of the characteristic features during the extraction phase, Auditory Scene Analysis (ASA) techniques are employed.

Further provided are the methods as described above, whereby one or several of the following auditory characteristics are identified during the extraction of said characteristic features: Volume, spectral pattern, harmonic structure, common build-up and decay processes, coherent amplitude modulations, coherent frequency modulations, coherent frequency transitions and binaural effects.

Also provided are the methods described above, whereby any other suitable characteristics are identified in addition to the auditory characteristics.

Further provided are the methods as described above, whereby, for the purpose of creating auditory objects, the auditory and any other characteristics are grouped along the principles of the gestalt theory.

In addition, provided is the method above whereby the extraction of characteristics and/or the grouping of the characteristics are/is performed either in context-free or in context-sensitive fashion in the sense of human auditory perception, taking into account additional information or hypotheses relative to the signal content and thus providing an adaptation to the respective acoustic scene.

Also provided are the methods described above, whereby, during the identification phase, data are accessed which were acquired in an off-line training phase.

Still further provided are the methods described above, whereby the extraction phase and the identification phase take place in continuous fashion or at regular or irregular time intervals.

And even further provided are the methods provided above, whereby, on the basis of a detected transient acoustic scene, a program or a transmission function between at least one microphone and a receiver in the hearing device is selected.

Provided also are the methods above, whereby, in response to a detected transient acoustic scene, a detected sound, a detected voice or a detected word, a particular function is triggered in the hearing device.

Also provided is a hearing device with a transmission unit whose input end is connected to at least one microphone and whose output end is functionally connected to a receiver, characterized in that the input signal of the transmission unit is simultaneously fed to a signal analyzer for the extraction of characteristic features, and that the signal analyzer is functionally connected to a signal identifier unit in which, with the aid of Hidden Markov Models, the identification especially of a transient acoustic scene or sound and/or the recognition of a voice or of words takes place.

Further provided is the hearing device above, characterized in that the signal identifier unit is functionally connected to the transmission unit for selecting a program or a transmission function.

Further provided are the hearing devices above, characterized in that a user input unit is provided which is functionally connected to the transmission unit.

Still further provided is are the hearing devices above, characterized in that a control unit is provided and that the signal identifier unit is functionally connected to said control unit.

In addition is the hearing device provided above, characterized in that the user input unit is functionally connected to the control unit.

Even further provide is a hearing device as described above, characterized in that the device is provided with suitable means serving to transfer parameters from a training unit to the signal identifier unit.

The invention is based on an extraction of signal characteristics with the subsequent separation of different audio sources as well as the identification of different sounds, employing Hidden Markov models in the identification phase for detecting a momentary acoustic scene or noises and/or a speaker, i.e. the words spoken by him. For the first time ever, this method takes into account the dynamic properties of the categories of interest, by means of which it has been possible to achieve significantly improved precision of the method disclosed in all areas of application, i.e. in the detection of momentary acoustic scenes and noises as well as in the recognition of a speaker and of individual words.

In another form of implementation of the method per this invention, auditory characteristics are employed in the extraction phase in lieu of or in addition to the technically based characteristics. The detection of these auditory characteristics is preferably accomplished by means of Auditory Scene Analysis (ASA) methodology.

In yet another form of implementation of the method per this invention, the extraction phase includes a context-free or a contextual grouping of the characteristics with the aid of the gestalt principles.

BRIEF DESCRIPTION OF THE DRAWINGS

The following will explain this invention in more detail by way of an example with eference to a drawing.

FIG. 1 is a functional block diagram of a hearing device in which the method per this invention has been implemented.

In FIG. 1, the reference number 1 designates a hearing device. For the purpose of the following description, the term "hearing device" is intended to include hearing aids as used to compensate for the hearing impairment of a person, but also all other acoustic communication systems such as radio transceivers and the like.

The hearing device 1 incorporates in conventional fashion two electro-acoustic converters 2*a*, 2*b* and 6, these being one or several microphones 2*a*, 2*b* and a speaker 6, also referred to as a receiver. A main component of a hearing device 1 is a transmission unit 4 in which, in the case of a hearing aid, signal modification takes place in adaptation to the requirements of the user of the hearing device 1. However, the operations performed in the transmission unit 4 are not only a function of the nature of a specific purpose of the hearing device 1 but are also, and especially, a function of the momentary acoustic scene. There have already been hearing aids on the market where the wearer can manually switch between different hearing programs tailored to specific acoustic situations. There also exits hearing aids capable of automatically recognizing the acoustic scene. In that connection, reference is again made to the European patents EP-B1-0 732 036 and EP-A1-0 814 636 and to the U.S. Pat. No. 5,604,812, as well as to the "Claro Autoselect" brochure by Phonak-Hearing Systems (28148 (GB)/0300, 1999).

In addition to the aforementioned components such as microphones 2*a*, 2*b*, the transmission unit 4 and the receiver 6, the hearing device 1 contains a signal analyzer 7 and a signal identifier 8. If the hearing device 1 is based on digital technology, one or several analog-to-digital converters 3*a*, 3*b* are interpolated between the microphones 2*a*, 2*b* and the transmission unit 4 and one digital-to-analog converter 5 is provided between the transmission unit 4 and the receiver 6. While a digital implementation of this invention is preferred, it should be equally possible to use analog components throughout. In that case, of course, the converters 3*a*, 3*b* and 5 are not needed.

The signal analyzer 7 receives the same input signal as the transmission unit 4. The signal identifier 8, which is connected to the output of the signal analyzer 7, connects at the other end to the transmission unit 4 and to a control unit 9.

A training unit 10 serves to establish in off-line operation the parameters required in the signal identifier 8 for the classification process.

By means of a user input unit 11, the user can override the settings of the transmission unit 4 and the control unit 9 as established by the signal analyzer 7 and the signal identifier 8.

The method according to this invention is explained as follows:

A preferred form of implementation of the method per this invention is based on the extraction of characteristic features from an acoustic signal during an extraction phase, whereby, in lieu of or in addition to the technically based characteristics—such as the above-mentioned zero-passage rates, time-related sound-level fluctuations, different modulation frequencies, the sound level itself, the spectral peak, the amplitude distribution etc.—auditory characteristics as well are employed. These auditory characteristics are determined by means of an Auditory Scene Analysis (ASA) and include in particular the loudness, the spectral pattern (timbre), the harmonic structure (pitch), common build-up and decay times (on-/offsets), coherent amplitude modulations, coherent frequency modulations, coherent frequency transitions, binaural effects etc. Detailed descriptions of Auditory Scene Analysis can be found for instance in the articles by A. Bregman, "Auditory Scene Analysis" (MIT Press, 1990) and W. A. Yost, "Fundamentals of Hearing—An Introduction" (Academic Press, 1977). The individual auditory characteristics are described, inter alia, by A. Yost and S. Sheft in "Auditory Perception" (published in "Human Psychophysics" by W. A. Yost, A. N. Popper and R. R. Fay, Springer 1993), by W. M. Hartmann in "Pitch, Periodicity, and Auditory Organization" (Journal of the Acoustical Society of America, 100 (6), pp 3491–3502, 1996), and by D. K. Mel1inger and B. M. Mont-Reynaud in "Scene Analysis" (published in "Auditory Computation" by H. L. Hawkins, T. A. McMullen, A. N. Popper and R. R. Fay, Springer 1996).

In this context, an example of the use of auditory characteristics in signal analysis is the characterization of the tonality of the acoustic signal by analyzing the harmonic structure, which is particularly useful in the identification of tonal signals such as speech and music.

Another form of implementation of the method according to this invention additionally provides for a grouping of the characteristics in the signal analyzer 7 by means of Gestalt principles. This process applies the principles of the Gestalt theory, by which such qualitative properties as continuity, proximity, similarity, common fate, unity, good continuation and others are examined, to the auditory and perhaps technically based characteristics for the creation of auditory objects. This grouping—and, for that matter, the extraction of characteristics in the extraction phase—can take place in context-free fashion, i.e. without any enhancement by additional knowledge (so-called "primitive" grouping), or in context-sensitive fashion in the sense of human auditory perception employing additional information or hypotheses regarding the signal content (so-called "schema-based" grouping). This means that the contextual grouping is adapted to any given acoustic situation. For a detailed explanation of the principles of the Gestalt theory and of the grouping process employing Gestalt analysis, substitutional reference is made to the publications titled "Perception Psychology" by E. B. Goldstein (Spektrum Akademischer Verlag, 1997), "Neural Fundamentals of Gestalt Perception" by A. K. Engel and W. Singer (Spektrum der Wissenschaft, 1998, pp 66–73), and "Auditory Scene Analysis" by A. Bregman (MIT Press, 1990).

The advantage of applying this grouping process lies in the fact that it allows further differentiation of the characteristics of the input signals. In particular, signal segments are identifiable which originate in different sound-sources. The extracted characteristics can thus be mapped to specific individual sound sources, providing additional information on these sources and, hence, on the current auditory scene.

The second aspect of the method according to this invention as described here relates to pattern recognition, i.e. the signal identification that takes place during the identification phase. The preferred form of implementation of the method per this invention employs the Hidden Markov Model (HMM) method in the signal identifier 8 for the automatic classification of the acoustic scene. This also permits the use of time changes of the computed characteristics for the classification process. Accordingly, it is possible to also take into account dynamic and not only static properties of the surrounding situation and of the sound categories. Equally possible is a combination of HMMs with other classifiers such as multi-stage recognition processes for identifying the acoustic scene.

According to the invention, the second procedural aspect mentioned, i.e. the use of Hidden Markov models, is particularly suitable for determining a momentary acoustic scene, meaning sounds. It also permits extremely good recognition of a speaker's voice and the discrimination of individual words or phrases, and that all by itself, i.e. without the inclusion of auditory characteristics in the extraction phase and without using ASA (auditory scene-analysis) methods which are employed in another form of implementation for the identification of characteristic features.

The output signal of the signal identifier 8 thus contains information on the nature of the acoustic surroundings (the acoustic situation or scene). That information is fed to the transmission unit 4 which selects the program, or set of parameters, best suited to the transmission of the acoustic scene discerned. At the same time, the information gathered in the signal identifier 8 is fed to the control unit 9 for further actions whereby, depending on the situation, any given function, such as an acoustic signal, can be triggered.

If the identification phase involves Hidden Markov Models, it will require a complex process for establishing the parameters needed for the classification. This parameter ascertainment is therefore best done in the off-line mode, individually for each category or class at a time. The actual identification of various acoustic scenes requires very little memory space and computational capacity. It is therefore recommended that a training unit 10 be provided which has enough computing power for parameter determination and which can be connected via appropriate means to the hearing device 1 for data transfer purposes. The connecting means mentioned may be simple wires with suitable plugs.

The method according to this invention thus makes it possible to select from among numerous available settings and automatically pollable actions the one best suited without the need for the user of the device to make the selection. This makes the device significantly more comfortable for the user since upon the recognition of a new acoustic scene it promptly and automatically selects the right program or function in the hearing device 1.

The users of hearing devices often want to switch off the automatic recognition of the acoustic scene and corresponding automatic program selection, described above. For this purpose a user input unit 11 is provided by means of which it is possible to override the automatic response or program selection. The user input unit 11 may be in the form of a switch on the hearing device 1 or a remote control which the user can operate.

There are also other options which offer themselves, for instance a voice-activated user input device.

What is claimed is:

1. Method for operating a hearing aid (1), said method comprising steps of:

extracting, during an extraction phase, characteristics from an acoustic signal captured by at least one microphone (2*a*, 2*b*), processing, during an identification phase and with the aid of Hidden Markov Models, said characteristics for the determination of a momentary acoustic scene, said processing including mapping the extracted characteristics to specific individual sound sources, and generating an audio signal based on said characteristics for improving the hearing of a user, said generating including selecting and executing a hearing improving process from a plurality of available processes based on the identified momentary acoustic scene.

2. Method as in claim 1, further comprising the step of identifying auditory features from the characteristics extracted during the extraction phase.

3. Method as in claim 2, wherein, during the identification phase, Auditory Scene Analysis (ASA) techniques are employed.

4. Method as in claim 2 or 3, wherein at least one of the following auditory-based features are identified during the extraction of said characteristics: loudness, spectral pattern, harmonic structure, common on- and offsets, coherent amplitude modulations, coherent frequency modulations, coherent frequency transitions and binaural effects.

5. Method as in claim 2, wherein, to create auditory objects, the auditory features are grouped along the principles of the Gestalt theory.

6. Method as in claim 5, wherein the grouping of the auditory features is performed either in context-free or in context-based fashion in the sense of human auditory perception, based upon additional information or hypotheses relative to a content of the acoustic signal and providing an adaptation to the respective acoustic scene.

7. Method as in claim 1 or 2, wherein during the identification phase, data is accessed which was acquired in an off-line training phase.

8. Method as in claim 1 or 2, wherein the extraction phase and the identification phase take place in continuous fashion or at regular or irregular time intervals.

9. Method as in claim 1 or 2, wherein on the basis of a detected momentary acoustic scene, a program or a transmission function between at least one microphone (2*a*, 2*b*) an a receiver (6) in the hearing aid (1) is selected.

10. Method as in claim 1 or 2, wherein in response to a detected momentary acoustic scene, a detected sound, a detected voice or a detected word, a particular function is triggered and executed in the hearing aid (1).

11. A hearing aid (1) comprising a transmission unit (4) comprising an input end being connected to at least one microphone (2*a*, 2*b*) and the transmission unit further comprising an output end being functionally connected to a receiver (6), wherein at least one input signal of the transmission unit (4) is simultaneously fed to a signal analyzer (7) for the extraction of characteristics, and that the signal analyzer (7) is operationally connected to a signal identifier unit (8) in which, with the aid of Hidden Markov Models, the identification of a momentary acoustic scene or sound and/or the recognition of a voice or of words takes place for selecting and executing a hearing improving process from a plurality of available processes based on said identification for improving the hearing of a user.

12. Hearing device (1) as in claim 11, characterized in that the signal identifier unit (8) is operationally connected to the transmission unit (4) for selecting a program or a transmission function.

13. Hearing device (1) as in claim 11 or 12, wherein a user input unit (11) is provided which is operationally connected to the transmission unit (4).

14. Hearing device (1) as in claim 13, wherein a control unit (9) is provided and that the signal identifier unit (8) is operationally connected to said control unit (9).

15. Hearing device (1) as in claim 14, wherein the user input unit (11) is operationally connected to the control unit (9).

16. Hearing device (1) as in claim 11 further comprising means to transfer parameters from a training unit (10) to the signal identifier unit (8).

17. Method as in claim 2, wherein, during the extraction step, the extracting of characteristics is performed either in context-free or in context-based fashion in a sense of human auditory perception, based upon additional information or hypothesis relative to the signal content and providing an adaptation to a respective acoustic scene.

18. Method for operating a hearing aid (1), said method comprising steps of:

extracting, during an extraction phase, characteristics from an acoustic signal captured by at least one microphone (2*a*, 2*b*);

processing, during an identification phase and with the aid of Hidden Markov Models, said characteristics for the determination of a momentary acoustic scene and/or for improving voice and word recognition by a user, said processing including mapping the extracted characteristics to specific individual sound sources; and modifying said acoustic signal according to the results of said processing for improving the hearing capability of a user by selecting and executing a hearing improving process from a plurality of available processes based on the identified momentary acoustic scene.

19. Method as in claim 18, wherein Auditory Scene Analysis (ASA) techniques are employed during said processing.

20. Method for operating a hearing aid (1), said method comprising steps of:

extracting, during an extraction phase, characteristics from an acoustic signal captured by at least one microphone (2*a*, 2*b*);

processing, during an identification phase and with the aid of Hidden Markov Models, said characteristics for the determination of a momentary acoustic scene and/or for improving voice and word recognition by a user, said processing including mapping the extracted characteristics to specific individual sound sources; and selecting a program or a transmission function between at least one microphone (2*a*, 2*b*) and a receiver (6) in the hearing aid (1) on the basis of the detected momentary acoustic scene for improving the hearing of a user.

21. Method as in claim 20, wherein Auditory Scene Analysis (ASA) techniques are employed during said processing.

22. Method as in claim 20, wherein a user can override said selecting a program or transmission function.

23. Method for operating a hearing aid (1), said method comprising steps of:

extracting, during an extraction phase, characteristics from an acoustic signal captured by at least one microphone (2*a*, 2*b*);

processing, during an identification phase and with the aid of Hidden Markov Models, said characteristics for the determination of a momentary acoustic scene and/or for improving voice and word recognition by a user, said processing including mapping the extracted characteristics to specific individual sound sources; and triggering a particular function in the hearing aid for improving the hearing of a user (1) in response to one or more of a detected momentary acoustic scene, a detected sound, a detected voice and a detected word.

24. Method as in claim 23, wherein Auditory Scene Analysis (ASA) techniques are employed during said processing.

25. Method as in claim 23, wherein a user can override said triggering a particular function.

26. A hearing aid (1) comprising a transmission unit (4) including an input end being connected to at least one microphone (2*a*, 2*b*) and the transmission unit further including an output end being functionally connected to a receiver (6), wherein at least one input signal of the transmission unit (4) is simultaneously fed to a signal analyzer (7) for the extraction of characteristics, and that the signal analyzer (7) is operationally connected to a signal identifier unit (8) in which, with the aid of Hidden Markov Models, the identification of a momentary acoustic scene takes place using Auditory Scene Analysis (ASA) said identification including mapping the extracted characteristics to specific individual sound sources.

27. Method as in claim 26, wherein said hearing aid selects a program or a transmission function for execution by said transmission unit on a basis of the detected momentary acoustic scene.

28. Method as in claim 27, wherein a user can override said selecting a program or transmission function.

29. Method as in claim 26, wherein a particular function is triggered in the hearing aid (1) in response to one or more of a detected momentary acoustic scene, a detected sound, a detected voice and a detected word.

30. Method as in claim 29, wherein a user can override said triggering a particular function.

31. A method for operating a hearing device for improving the hearing of a user, said method comprising steps of:

capturing an acoustic signal using one or more microphones;

extracting characteristics from said acoustic signal;

processing said characteristics for the determination of a momentary acoustic scene using Auditory Scene Analysis (ASA) techniques including mapping the extracted characteristics to specific individual sound sources; and selecting a hearing improvement process from a plurality of available processes by utilizing said techniques; and generating an audio signal for improving the hearing of the user by executing said selected process.

32. The method of claim 31 further including the step of triggering a particular function in the hearing device in response to said processing, wherein said generating an audio signal for improving the hearing of the user is in response to said triggering.

33. The method of claim 32, wherein the user can override said triggering a particular function.

* * * * *

UNITED STATES PATENT AND TRADEMARK OFFICE

CERTIFICATE OF CORRECTION

PATENT NO. : 6,895,098 B2
DATED : May 17, 2005
INVENTOR(S) : Silvia Allegro et al.

It is certified that error appears in the above-identified patent and that said Letters Patent is hereby corrected as shown below:

Delete the title page and substitute therefor the attached title page.

Delete the Drawing Sheet with the Figure and substitute therefor the attached Drawing Sheet with the Figure.

Title page,
Item [75], Inventors, please delete "Sylvia", and insert therefor -- Silvia --.
Item [*] Notice, please add the following statement:
-- This patent is subject to a terminal disclaimer. --.
Item [56], References Cited, U.S. PATENT DOCUMENTS, please insert the following:
-- 6,002,776 12/1999 Bhadkamkar --.
FOREIGN PATENT DOCUMENTS, please insert the following:
-- 01 76321 A 10/2001 WO
0 881 625 A 12/1998 EP
0 681 441 A 11/1995 EP --.
OTHER PUBLICATIONS, please insert the following:
-- Mellinger, D.K., "Feature-map methods for extracting sound frequency modulation" SIGNALS, SYSTEMS AND COMPUTERS, 1991, 1991 CONFERENCE RECORD OF THE TWENTY-FIFTH ASILOMAR CONFERENCE ON PACIFIC GROVE, CA, USA 4-6 Nov. 1991, Los Alamitos, CA, USA IEEE Comput. Soc. U. 4 Nov. 1991. --.

Column 4,
Line 13, please delete "eference", and insert therefor -- reference --.

Signed and Sealed this

Eleventh Day of October, 2005

JON W. DUDAS
*Director of the United States Patent and Trademark Office*

(12) United States Patent
Allegro et al.

(10) Patent No.: US 6,895,098 B2
(45) Date of Patent: May 17, 2005

(54) METHOD FOR OPERATING A HEARING DEVICE, AND HEARING DEVICE

(75) Inventors: Sylvia Allegro, Oetwil am See (CH); Michael Büchler, Zürich (CH)

(73) Assignee: Phonak AG, Stafa (CH)

( * ) Notice: Subject to any disclaimer, the term of this patent is extended or adjusted under 35 U.S.C. 154(b) by 295 days.

(21) Appl. No.: 09/755,468

(22) Filed: Jan. 5, 2001

(65) Prior Publication Data

US 2002/0090098 A1 Jul. 11, 2002

(51) Int. Cl.[7] ..... H04R 25/00
(52) U.S. Cl. ..... 381/312; 381/318
(58) Field of Search ..... 381/92, 312, 313, 381/314, 317, 318, 71.1, 94.3

(56) References Cited

U.S. PATENT DOCUMENTS 6,009,396 A * 12/1999 Nagata ..... 381/92
6,157,727 A * 12/2000 Rueda ..... 381/312
6,240,192 B1 * 5/2001 Brennan et al. ..... 381/314
6,453,284 B1 * 9/2002 Paschall ..... 381/94.3
6,529,866 B1 * 3/2003 Cope et al. ..... 381/94.3

OTHER PUBLICATIONS

Fundamentals of Hearing, Chapter 15, "Auditory Perception and Sound Source Determination", pp. 213–237, William A. Yost, 1977 by Academic Press, Inc.
Human Psychophysics, Chapter 6, "Auditory Perception", pp. 193–236, William A. Yost and Stanley Sheft, 1993.
Auditory Scene Analysis, Chapter 1, "The Auditory Scene", pp.1–45, Albert S. Bregman, 1990.

* cited by examiner

*Primary Examiner*—Suhan Ni
(74) *Attorney, Agent, or Firm*—Pearne & Gordon LLP

(57) ABSTRACT

A method for operating a hearing device (1) including the extraction, during an extraction phase, of characteristic features from an acoustical signal captured by at least one microphone (2a, 2b), and the processing, during an identification phase and with the aid of Hidden Markov Models, of the characteristic features especially for the determination of a momentary acoustic scene or of sounds and/or for voice and word recognition. A hearing device is also specified.

33 Claims, 1 Drawing Sheet

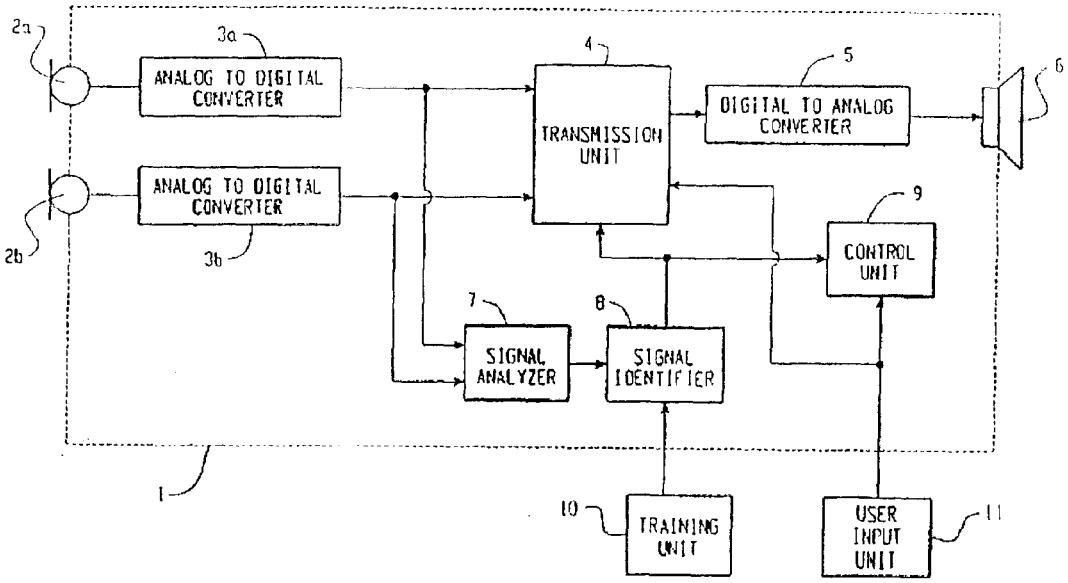

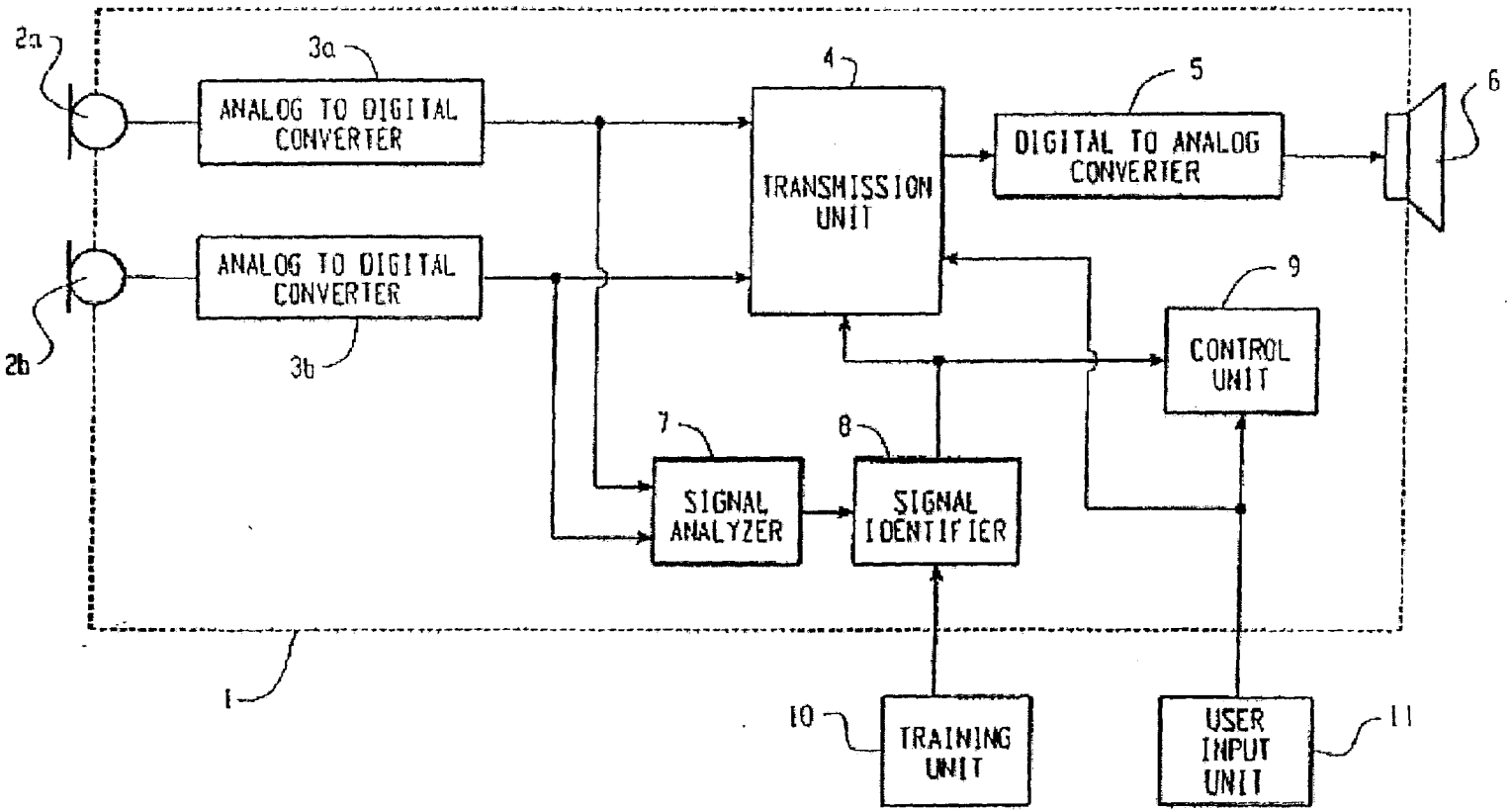
6
DIGITAL TO ANALOG CONVERTER
5
TRANSMISSION UNIT
4
ANALOG TO DIGITAL CONVERTER
3a
ANALOG TO DIGITAL CONVERTER
3b
2a
2b
CONTROL UNIT
9
SIGNAL IDENTIFIER
8
SIGNAL ANALYZER
7
USER INPUT UNIT
11
TRAINING UNIT
10
1